US009821549B2

(12) United States Patent
Yokoo et al.

(10) Patent No.: US 9,821,549 B2
(45) Date of Patent: Nov. 21, 2017

(54) FLOW PATH MEMBER, LIQUID EJECTING APPARATUS, AND PRODUCTION METHOD FOR FLOW PATH MEMBER

(71) Applicant: SEIKO EPSON CORPORATION, Tokyo (JP)

(72) Inventors: Ayumi Yokoo, Matsumoto (JP); Hiroyuki Nakamura, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/368,258

(22) Filed: Dec. 2, 2016

(65) Prior Publication Data

US 2017/0157929 A1 Jun. 8, 2017

(30) Foreign Application Priority Data

Dec. 4, 2015 (JP) ..... 2015-237714

(51) Int. Cl.
*B41J 2/14* (2006.01)
*B41J 2/01* (2006.01)

(52) U.S. Cl.
CPC ..... *B41J 2/01* (2013.01); *B41J 2/14145* (2013.01); *B41J 2002/14306* (2013.01)

(58) Field of Classification Search
CPC . B41J 2/01; B41J 2/14145; B41J 2002/14306
See application file for complete search history.

(56) References Cited

U.S. PATENT DOCUMENTS

2005/0068381 A1* 3/2005 Morita ..... B41J 2/175 347/84
2007/0277927 A1* 12/2007 Momose ..... B29C 66/73521 156/272.8
2011/0069119 A1* 3/2011 Morita ..... B23K 26/0661 347/44

FOREIGN PATENT DOCUMENTS

| | | |
|---|---|---|
| JP | 2005-096422 | 4/2005 |
| JP | 2006-341557 | 12/2006 |
| JP | 2007-320251 | 12/2007 |

* cited by examiner

*Primary Examiner* — Manish S Shah
*Assistant Examiner* — Yaovi M Ameh
(74) *Attorney, Agent, or Firm* — Workman Nydegger

(57) ABSTRACT

A flow path member includes a first flow path-forming member made of a material capable of absorbing a laser light and a second flow path-forming member made of a material that has a lower absorbance with respect to the laser light than the first flow path-forming member and having in a portion of an inner surface that at least partially forms a flow path at least one welded portion that is welded to the first flow path-forming member. An outer surface side of the second flow path-forming member that is an opposite side to the inner surface is provided with at least one light blocking portion capable of blocking the laser light and at least one transmitting portion that is capable of transmitting the laser light and that is positioned on an opposite side to the at least one welded portion and the at least one light blocking portion and the at least one transmitting portion are in contact on at least one boundary with each other. At least one external edge of the at least one welded portion is at a position that is shifted by a shift from the at least one boundary to a side toward which the laser light incident on the at least one boundary at an incident angle less than 90 degrees travels.

9 Claims, 5 Drawing Sheets

FLOW PATH MEMBER, LIQUID EJECTING APPARATUS, AND PRODUCTION METHOD FOR FLOW PATH MEMBER

BACKGROUND

1. Technical Field

The present invention relates to a flow path member in which a fluid, such as ink, flows, a production method for the flow path member, and a liquid ejecting apparatus, such as an ink jet type printer, which includes the flow path member.

2. Related Art

In some cases in the production of an ink cartridge that is fitted to an ink jet type printer, which is an example of a liquid ejecting apparatus, a container case and a lid member are laser-welded by irradiating the container case made of a laser-absorbing material with the laser light transmitted through the lid member made of a laser-transmitting material (e.g., JP-A-2007-320251).

If, in the laser welding as described above, the laser light is not delivered to an appropriate location, various welding failures occur; for instance, a portion that needs to be left unfused is fused and that fused material forms an unnecessary protrusion or a portion that needs to be welded is not sufficiently welded.

Particularly, in the case where the laser welding is performed by scanning laser light by, for example, pivoting a mirror that reflects laser light, if laser light is obliquely incident on the lid member, the irradiated position on the container case shifts from the position of incidence on the lid member, so that a welding failure is likely to occur. Furthermore, in the case where, in the production of a flow path member, a laser welding failure results from shift of the irradiated position, there is possibility that a fluid may leak from an insufficiently welded site or a fused piece protruded into a flow path may impede flow of a fluid.

Such problems are not confined to flow paths in which ink flows but substantially common to flow path members in which a liquid flows, liquid ejecting apparatuses that include such flow path members, and production methods for such flow path members.

SUMMARY

An advantage of some aspects of the invention is that a flow path member in which a plurality of flow path-forming members has been appropriately welded, a liquid ejecting apparatus that includes the flow path member, and a production method for the flow path member are provided.

Regarding the flow path member, the liquid ejecting apparatus, and the production method for the flow path member of the invention, the constructions and advantageous effects will be briefly described below.

One aspect of the invention provides a flow path member in which a plurality of flow path-forming members forms a flow path. The flow path member includes a first flow path-forming member made of a material capable of absorbing a laser light and a second flow path-forming member made of a material that has a lower absorbance with respect to the laser light than the first flow path-forming member and having in a portion of an inner surface that at least partially forms the flow path at least one welded portion that is welded to the first flow path-forming member. An outer surface side of the second flow path-forming member that is an opposite side to the inner surface is provided with at least one light blocking portion capable of blocking the laser light and at least one transmitting portion that is capable of transmitting the laser light and that is positioned on an opposite side to the at least one welded portion. The at least one light blocking portion and the at least one transmitting portion are in contact on at least one boundary with each other. At least one external edge of the at least one welded portion is at a position that is shifted by a shift from the at least one boundary to a side toward which the laser light incident on the at least one boundary at an incident angle less than 90 degrees travels.

When the second flow path-forming member and the first flow path-forming member are welded by laser light transmitted through the second flow path-forming member, an external edge of a welded portion is formed at a position that the laser light passing through the boundary between a light blocking portion and a transmitting portion reaches. If the incident angle of the laser light on the boundary is 90 degrees, the boundary and the external edge coincide in position when viewed in a direction orthogonal to the outer surface. However, if the incident angle of the laser light on the boundary is less than 90 degrees, the external edge of the welded portion shifts in position from the boundary to the side toward which the laser light travels. In this respect, according to the foregoing construction, since the position of the external edge of the welded portion is set according to the incident angle of the laser light, the first flow path-forming member and the second flow path-forming member are appropriately welded. Therefore, a flow path member in which flow path-forming members are appropriately welded can be provided.

In the foregoing flow path member, the outer surface of the second flow path-forming member may be provided with a plurality of the at least one boundary that intersects a straight line connecting a first reference position and a second reference position that are apart from each other. Furthermore, each of the at least one external edge of the at least one welded portion may be shifted in position from a corresponding one of the plurality of boundaries by the shift that becomes larger from the first reference position toward the second reference position.

According to this embodiment, the shifts of the external edges of the welded portions are progressively larger from the first reference position toward the second reference position. Therefore, even if a light source apparatus disposed at a position closer to the first reference position than to the second reference position in a space in contact with the outer surface of the second flow path-forming member emits laser light while pivoting the laser light, appropriate welding is carried out. Hence, the flow path of the flow path member formed by the first flow path-forming member and the second flow path-forming member that are appropriately welded as described above will not have neither an unnecessary fused piece that disturbs fluid flow nor insufficient welding that results in liquid leakage.

In the foregoing flow path member, the at least one light blocking portion may include an inner-side light blocking portion that corresponds to an inner-side external edge of one of the at least one welded portion which is closer to the first reference position than an outer-side external edge of the one of the at least one welded portion and that is shifted in position so as to be apart from the inner-side external edge and an outer-side light blocking portion that corresponds to the outer-side external edge of the one of the at least one welded portion which is closer to the second reference position than the inner-side external edge of the one of the at least one welded portion and that is shifted in position so as to lie over the outer-side external edge.

According to this embodiment, a welded portion of the second flow path-forming member is provided so that the position of the inner-side external edge of that welded portion is set by a corresponding inner-side light blocking portion that is shifted in position so as to be apart from the inner-side external edge and the position of the outer-side external edge of the welded portion is set by a corresponding outer-side light blocking portion that is shifted in position so as to lie over the outer-side external edge. Therefore, welding failure is unlikely to occur.

In the foregoing flow path member, the shift of the outer-side light blocking portion may be larger than the shift of the inner-side light blocking portion.

Because laser light incident on a region between the inner-side light blocking portion and the outer-side light blocking portion of the second flow path-forming member penetrates the second flow path-forming member, the second flow path-forming member is provided with a welded portion formed due to the welding with to the first flow path-forming member. The incident angle of the laser light that reaches the outer-side external edge of the welded portion which is closer to the second reference position than the inner-side external edge thereof is smaller than the incident angle of the laser light that reaches the inner-side external edge of the same welded portion which is closer to the first reference position than the outer-side external edge. Therefore, according to the foregoing embodiment, by shifting the outer-side light blocking portion to a greater extent than the inner-side light blocking portion so that the two light blocking portions are appropriately disposed according to the incident angles of laser light, the positions of the external edges of the welded portion can be appropriately set. Due to this, it is possible to substantially prevent the occurrence of a fused piece caused by excessively shifting the inner-side light blocking portion and the insufficient welding caused by insufficiently shifting the inner-side light blocking portion. It is also possible to substantially prevent the insufficient welding caused by excessively shifting the outer-side light blocking portion and the occurrence of a fused piece caused by insufficiently shifting the outer-side light blocking portion.

In the foregoing flow path member, the first flow path-forming member may have a protruded portion that is welded to the second flow path-forming member to become the welded portion, the protruded portion may have an inner wall surface that extends in a direction intersecting the irradiation surface and that forms the flow path, and the protruded portion may have a cutout in a portion of a corner that is substantially defined by an extension of the irradiation surface and an extension of the inner wall surface intersecting each other.

According to this embodiment, since the protruded portion of the first flow path-forming member has in its corner portion a cutout, the cutout can receive therein a fused piece or material if any such fused piece or material should be produced because laser light is delivered to a location outside the irradiation surface due to production errors and the like of the flow path-forming members. In consequence, formation of a fused piece that is protruded from an inner wall surface into the flow path so as to impede liquid flow can be avoided.

In the foregoing flow path member, the light blocking portion may be a rough surface that has a greater surface roughness than the transmitting portion.

According to this embodiment, the laser light that is incident on the rough surface of the second flow path-forming member reflects in various directions and thus scatters, so that the quantity of laser light that reaches the first flow path-forming member is reduced. Thus, the light blocking portion made up of a rough surface can block laser light incident from the outer surface side. Furthermore, if the light blocking portion is a rough surface, the light blocking portion can be easily disposed on the second flow path-forming member.

In the foregoing flow path member, the light blocking portion may be a portion of the outer surface of the second flow path-forming member that is colored in a color capable of reflecting or absorbing the laser light.

According to this embodiment, the laser light incident on the colored portion of the second flow path-forming member is reflected or absorbed, so that the quantity of laser light that reaches a fusing surface is reduced. Thus, the light blocking portion made up of a colored outer surface of the second flow path-forming member can block laser light incident from the outer surface side. Furthermore, by forming the light blocking portion through coloring, the light blocking portion of the second flow path-forming member can be easily provided.

A second aspect of the invention provides a liquid ejecting apparatus that includes a liquid ejecting unit that ejects a liquid and the foregoing flow path member.

The occurrences of incomplete discharge or ejection of a liquid resulting from welding failure of the flow path member can be inhibited.

A third aspect of the invention provides a production method for producing a flow path member that includes a flow path by laser-welding a plurality of flow path-forming members. The production method includes: disposing a first flow path-forming member made of a material capable of absorbing a laser light and a second flow path-forming member made of a material that has a lower absorbance with respect to the laser light than the first flow path-forming member so that an irradiation surface of the first flow path-forming member and a welding surface of the second flow path-forming member are in contact with each other; providing a light blocking portion capable of blocking the laser light on an outer surface side of the second flow path-forming member which is an opposite side to an inner surface provided with the welding surface so that the light blocking portion is in contact on a boundary with a transmitting portion that transmits the laser light to the welding surface; and irradiating, after the first flow path-forming member and the second flow path-forming member are provided and the light blocking portion is provided, the irradiation surface with the laser light transmitted through the transmitting portion by emitting the laser light from a light source apparatus that is disposed in a space in contact with the outer surface of the second flow path-forming member. When a position at which an optical path extending from the light source apparatus intersects a virtual plane that contains the outer surface is defined as a first reference position and a position at which the laser light is incident on the virtual plane at a smaller incident angle than at the first reference position is defined as a second reference position, the light blocking portion is disposed so that the boundary is shifted toward the first reference position with respect to an external edge of the irradiation surface.

In this production method, since the light blocking portion is disposed so that the boundary is shifted in position from the external edge of the irradiation surface in the direction from the second reference position to the first reference position, the transmitting portion in contact on the boundary with the light blocking portion is shifted in position relative to the irradiation surface according to the incident angle of the laser light. Therefore, even in the case where the incident angles of laser light vary, the positions irradiated with laser light can be set according to the variations of the incident angles so as to coincide with the irradiation surfaces. Therefore, a flow path member in which flow path-forming members are appropriately welded can be provided.

BRIEF DESCRIPTION OF THE DRAWINGS

The invention will be described with reference to the accompanying drawings, wherein like numbers reference like elements.

DESCRIPTION OF EXEMPLARY EMBODIMENTS

Exemplary embodiments of the liquid ejecting apparatus of the invention will be described in detail hereinafter with reference to the drawings. The liquid ejecting apparatus is, for example, an ink jet type printer that performs recording (printing) by ejecting ink, which is an example of a liquid, to a target such as a sheet of paper.

Figure 1:
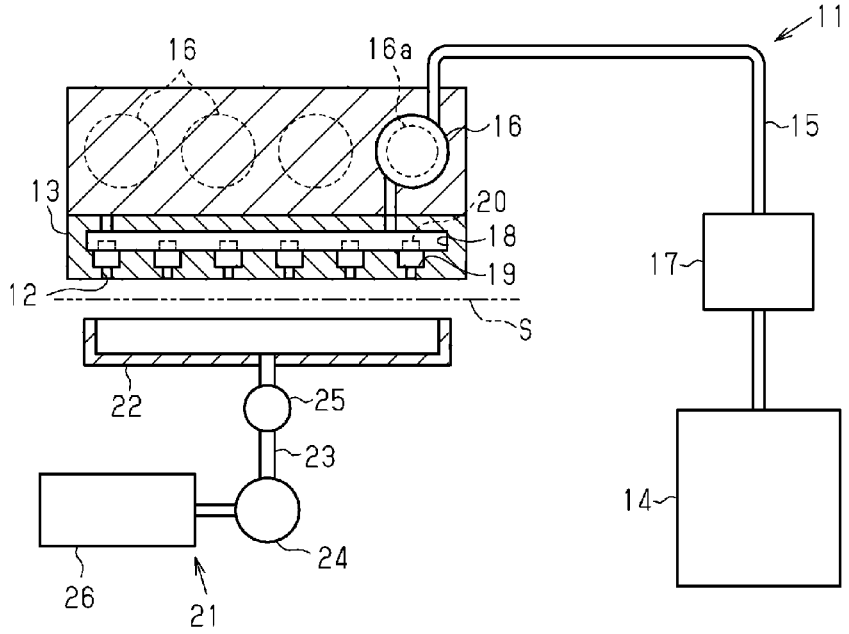
FIG. 1 is a sectional view schematically illustrating an exemplary embodiment of the liquid ejecting apparatus of the invention.

As shown in FIG. 1, the liquid ejecting apparatus 11 includes a liquid ejecting unit 13 that ejects a liquid from nozzles 12 to a target S, a liquid supply flow path 15 that connects a liquid supply source 14 and the liquid ejecting unit 13, and a pressure regulating mechanism 16 that adjusts the pressure of the liquid supplied to the liquid ejecting unit 13. The liquid ejecting apparatus 11 further includes a pump mechanism 17 that sucks the liquid from the liquid supply source 14 and that discharges the liquid toward the liquid ejecting unit 13 and also includes a maintenance mechanism 21 that performs a maintenance operation for maintaining good liquid ejection characteristics of the liquid ejecting unit 13.

The liquid ejecting apparatus 11 may be a line head type printer that has a line head that includes as component elements a plurality of liquid ejecting units 13 disposed side by side so that the printing range substantially covers the entire width of the target S. The liquid ejecting apparatus 11 may also be a serial type printer that performs printing while moving the liquid ejecting unit 13 back and forth in the width direction of the target S.

The pressure regulating mechanism 16 includes a pressure regulation valve 16*a* and is constructed so that when the pressure downstream of the pressure regulation valve 16*a* decreases to less than a predetermined negative pressure as the liquid is consumed, the pressure regulation valve 16*a* is opened so as to permit the liquid to be supplied to the downstream side. Furthermore, the pressure regulation valve 16*a* closes when the liquid is supplied so that the pressure downstream of the pressure regulation valve 16*a* rises to a predetermined negative pressure. Therefore, even if the pump mechanism 17 supplies the pressurized liquid to the upstream side of the pressure regulation valve 16*a*, the pressure of the liquid in a region from the pressure regulation valve 16*a* to the nozzles 12 is held at a predetermined negative pressure.

The liquid supply source 14, the liquid supply flow path 15, and the pressure regulating mechanism 16 are provided separately for each of the kinds of liquids that the liquid ejecting unit 13 ejects. For example, in the case where the liquid ejecting unit 13 ejects four kinds of liquids (four different color inks), four liquid supply sources 14, four liquid supply flow paths 15, and four pressure regulating mechanisms 16 are provided for one liquid ejecting unit 13.

Each liquid ejecting unit 13 includes common liquid chambers 18 that are provided separately for the kinds of liquids and that temporarily store the liquids supplied through the corresponding liquid supply flow paths 15, a plurality of pressure chambers 19 provided corresponding one-to-one to the nozzles 12 and disposed between the nozzles 12 and the common liquid chambers 18, and a plurality of actuators 20 provided corresponding one-to-one to the pressure chambers 19. When an actuator 20 is driven to change the pressure in the corresponding pressure chamber 19, the liquid is ejected through the corresponding nozzle 12.

The maintenance mechanism 21 includes a cap 22 that covers the nozzles 12 of the liquid ejecting unit 13, a suction pump 24 connected to the cap 22 through a suction flow path 23, an open/close valve 25 provided on the suction flow path 23 between the cap 22 and the suction pump 24, and a waste liquid containing portion 26 to which a downstream end of the suction flow path 23 is connected.

While the nozzles 12 are covered with the cap 22, the suction pump 24 is driven to apply a negative pressure on the nozzles 12, so that the liquids are sucked and discharged out of the nozzles 12. The liquid discharged from the nozzles 12 by suction is stored as a waste liquid in the waste liquid containing portion 26.

Next described will be a flow path member 31 for use for the liquid supply flow path 15, the pressure regulating mechanism 16, the liquid ejecting unit 13, the maintenance mechanism 21, etc., in which fluids, such as the liquids, including the waste liquid, flow in the liquid ejecting apparatus 11. Note that the fluid that flows in the flow path member 31 is not limited to liquid but may be, for example, a gas, such as air, for use for sucking or ejecting a liquid, and may also be a mixture fluid made up of a liquid and a gas, etc.

Figure 2:
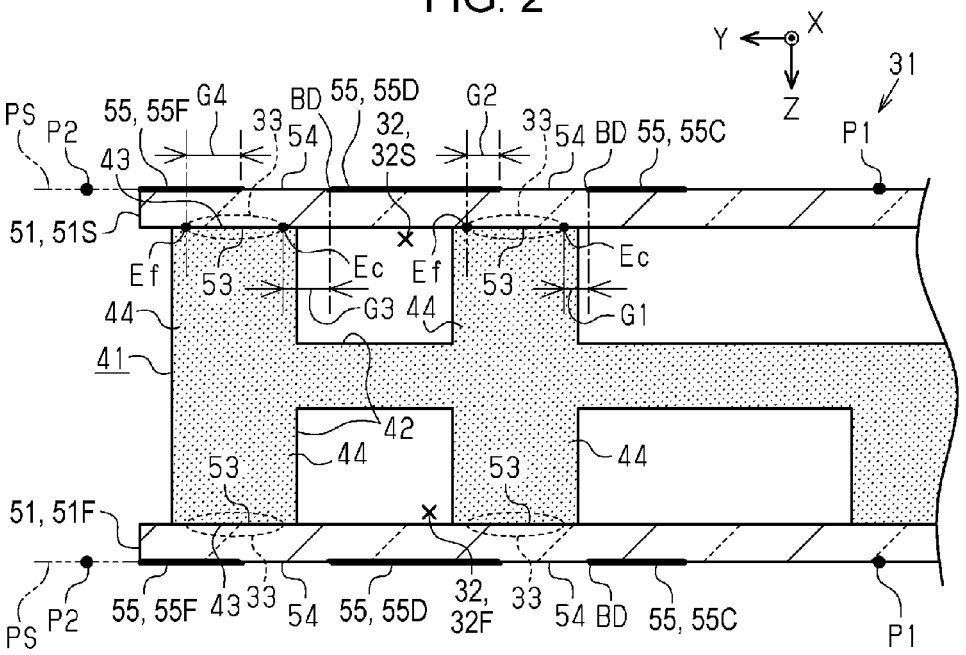
FIG. 2 is a sectional view schematically illustrating an exemplary embodiment of the flow path member of the invention.

In the flow path member 31, as shown in FIG. 2, a plurality of flow path-forming members 41 and 51 (51F and 51S) form flow paths 32 (32F and 32S) in which a fluid is to flow. For example, a first flow path-forming member 41 has recess portions 42 on one surface side (a lower surface side in FIG. 2) thereof that forms a flow path 32 and another surface side (an upper surface side in FIG. 2) that is opposite to the one surface side and that forms a flow path 32. These recess portions 42 are covered with thin platy second flow path-forming members 51F and 51S so that flow paths 32F and 32S are enclosed and formed.

The flow paths 32F and 32S may convey the same fluid or may also convey different fluids. Furthermore, the shapes of the flow paths 32 can be arbitrarily changed. In a plan view of the first flow path-forming member 41 taken from the one surface side or the other surface side, the flow path 32 may be a flow path that linearly extends. Furthermore, the flow path 32 may be a liquid storage portion having a circular or rectangular shape in the same plan view.

The first flow path-forming member 41 is made of a material that fuses by absorbing laser light and has a plurality of protruded portions 44 that are protruded to the second flow path-forming member 51. The distal end of each protruded portion 44 is provided with an irradiation surface 43 that fuses by absorbing laser light. Each of the irradiation surfaces 43 of the first flow path-forming member 41 is set within a distal end surface of a corresponding one of the protruded portion 44 in contact with the second flow path-forming member 51, with an outer edge portion of the distal end surface excluded from the irradiation surface 43.

Each second flow path-forming member 51 is a platy or film-shaped member made of a material having a lower absorbance with respect to laser light than the material of the first flow path-forming member 41. Portions of the inner surface of each second flow path-forming member 51 which partially form the flow paths 32 are provided with welding surfaces 53 that are welded to the irradiation surfaces 43 of the first flow path-forming member 41. As for the material of the first flow path-forming member 41, it is preferable that, when a 2.0 mm thick member made of the material is irradiated with laser light, the member's laser light absorbance be 90% or higher. For example, the height of the protruded portions 44 of the first flow path-forming member 41 may be set to about 3 mm. Furthermore, as for the second flow path-forming members 51, it is preferable that the laser light transmittance when a 2.0 mm thick member is irradiated with laser light be 30% or higher. For example, the second flow path-forming members 51 may have a thickness of 1.5 mm.

The welding surfaces 53 and the irradiation surfaces 43 are laser-welded by laser light delivered to the irradiation surfaces 43, so as to form welded portions 33. If a second flow path-forming member 51 of a flow path member 31 has been formed from an elastomer or has a film shape, the second flow path-forming member 51 undergoes bending displacement according to change in pressure in the flow path 32, so that that flow path member 31 can be used as a pressure regulation chamber or a valve chamber.

The flow path-forming members 41 and 51 that are to be mutually welded may be formed from the same kind of material, for example, a crystalline resin such as polypropylene, and may also be formed from different kinds of amorphous materials similar in molecular structure and melting point, such as ABS resins, acrylic resins, or modified PPE resins.

As for each second flow path-forming member 51, the outer surface side that is an opposite side to the inner surface provided with the welded portions 33 is provided with transmitting portions 54 that are capable of transmitting laser light and that are located opposite to the welded portions 33 (welding surfaces 53) and light blocking portions 55 capable of blocking laser light. The transmitting portions 54 and the light blocking portions 55 are in contact with boundaries BD. The light blocking portions 55 of each second flow path-forming member 51 are portions of the outer surface thereof that have been colored in a color capable of reflecting or absorbing laser light. What is indicated by "color" or "colored" herein is not limited to visible colors but includes, for example, a material that looks transparent and that is capable of reflecting or absorbing a laser beam having a wavelength for welding use. Incidentally, the light blocking portions 55 may be rough surfaces whose surface roughness has been made greater than that of the transmitting portions 54 by a blast process or the like.

For example, when a light blocking portion 55 is at an end of a second flow path-forming member 51, the light blocking portion 55 may be provided as a surface inclined or curved relative to the transmitting portions 54 formed by a flat surface of the second flow path-forming member 51 so that the inclined or curved surface reflects or refracts laser light and thus obstructs the travel of the laser light. In the case where laser light is refracted by the inclined or curved surface, the refracted light may be delivered to an irradiation surface 43 so as to be used as energy for welding the irradiation surface 43.

Let it assumed that a first reference position P1 and a second reference position P2 apart from each other in a direction Y are set on the outer surface of the second flow path-forming member 51. The first reference position P1 is a position at which laser light coming from a point in a space in contact with the outer surface of the second flow path-forming member 51 is incident on the outer surface at an incident angle of 90 degrees or approximately 90 degrees. The second reference position P2 is a position at which laser light from the same point, when scanned in the direction Y, is incident on the outer surface at an incident angle that is smaller than the incident angle at the first reference position P1. An external edge of a welded portion 33 apart in the direction Y from the first reference position P1 is at a position shifted in the direction Y from the adjacent boundary BD between a transmitting portion 54 and a light blocking portion 55 to a side toward which the laser light incident on the boundary BD at an incident angle less than 90 degrees travels.

The first reference position P1 and the second reference position P2 do not necessarily need to be on the outer surface of the second flow path-forming member 51 but are appropriate if they are on a virtual plane PS that contains the outer surface of the second flow path-forming member 51 on which laser light is incident. Furthermore, the incident angle of laser light at the first reference position P1 can be arbitrarily changed. Note that if the virtual plane PS that contains the outer surface of the second flow path-forming member 51 is a horizontal plane orthogonal to a gravity direction Z, a straight line connecting the first reference position P1 and the second reference position P2 extends in the direction Y orthogonal to the gravity direction Z. Furthermore, a direction X is a direction orthogonal to both the gravity direction Z and the direction Y.

If the outer surface of the second flow path-forming member 51 has a plurality of boundaries BD that intersect the straight line connecting the first reference position P1 and the second reference position P2 apart from each other, it is preferable that the positional shifts of the external edges of welded portions 33 which correspond one-to-one to the boundaries BD be progressively larger from the first reference position P1 toward the second reference position P2. For example, it is preferable that the positional shifts G1, G2, G3, and G4 of the external edges of welded portions 33 which correspond one-to-one to boundaries BD located in order from the side closer to the first reference position P1 become gradually larger according to the distance from the first reference position P1. That is, it is preferable that G1<G2<G3<G4.

Each second flow path-forming member 51 in this exemplary embodiment is provided with a plurality of welding surfaces 53 that are welded one-to-one to irradiation surfaces 43 of the second flow path-forming member 51. The light blocking portions 55 include an inner-side light blocking portion 55C that corresponds to an inner-side external edge Ec of a welded portion 33 (welding surface 53) which is closer to the first reference position P1 than an outer-side external edge Ef thereof is and that is shifted in position so that the inner-side light blocking portion 55C lies apart from the inner-side external edge Ec and an outer-side light blocking portion 55F that corresponds to the outer-side external edge Ef of the same welded portion 33 (welding surface 53) which is closer to the second reference position P2 than the inner-side external edge Ec thereof is and that is shifted in position so that the outer-side light blocking portion 55F lies over the outer-side external edge Ef. Note that a light blocking portion 55D shown in FIG. 2 is a consolidated portion made up of an inner-side light blocking portion 55C and an outer-side light blocking portion 55F.

In this case, it is preferable that the shifts G2 and G4 of the outer-side light blocking portions 55F be larger than the shifts G1 and G3 of the inner-side light blocking portions 55C, respectively. Furthermore, as for the shifts of the boundaries BD from the corresponding external edges of the welded portions 33, it is preferable that the boundaries BD of a light blocking portion 55 closer to the second reference position P2 have larger shifts than the boundaries BD of a light blocking portion 55 closer to the first reference position P1.

Next, a production method for producing a flow path member 31 that includes flow paths 32 by laser-welding a plurality of flow path-forming members 41 and 51.

Figure 3:
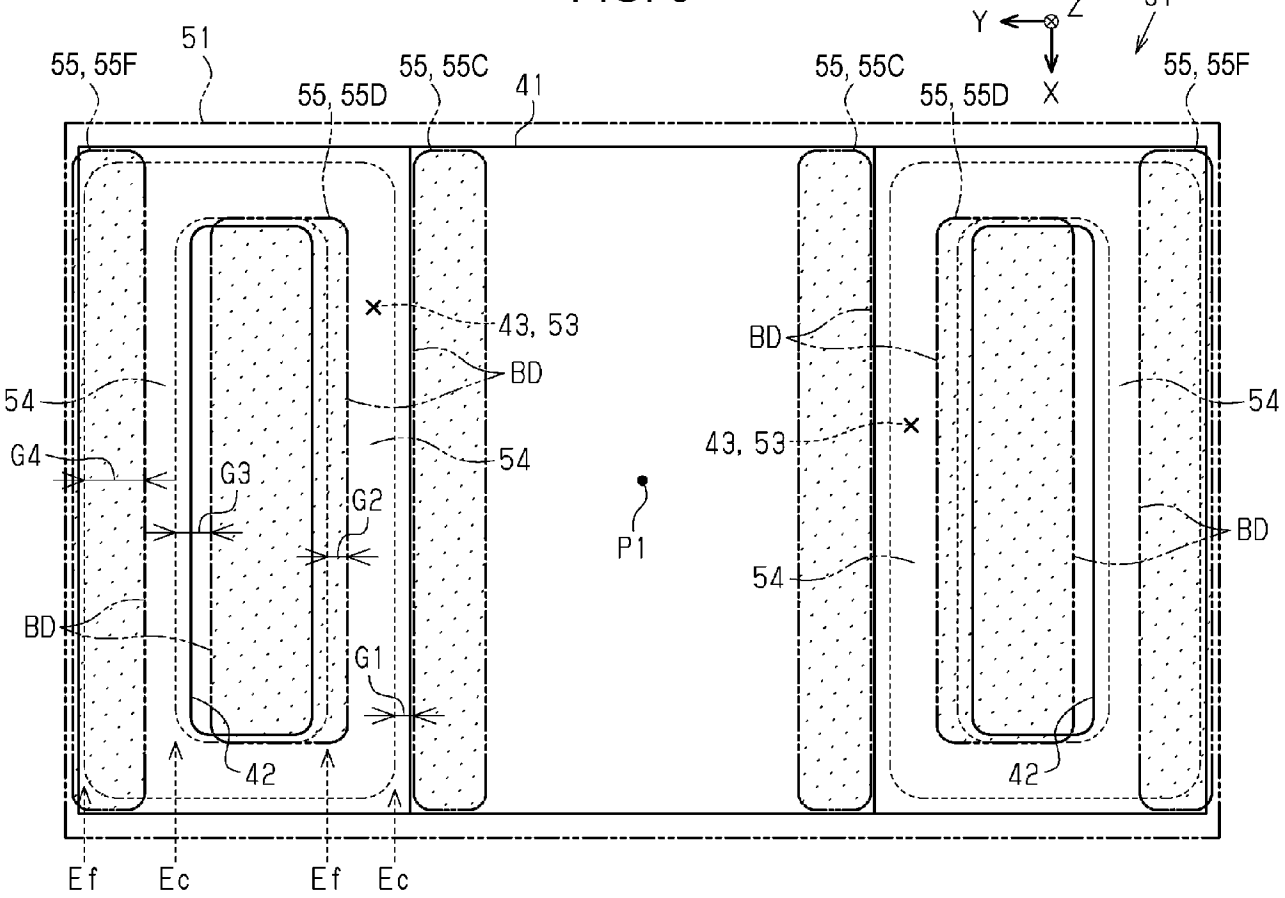
FIG. 3 is a plan view illustrating a process of the production of the flow path member shown in FIG. 2 in which a second flow path-forming member provided with light blocking portions is disposed on a first flow path-forming member.

First, as indicated by a two-dot chain line in FIG. 3, the outer surface side of the second flow path-forming member 51 that is the opposite side to the inner surface that is provided with welding surfaces 53 is provided with light blocking portions 55 (55C, 55D, and 55F) that are capable of blocking laser light. The light blocking portions 55 are disposed in contact, on boundaries BD, with transmitting portions 54 that transmit laser light to the welding surfaces 53 (light blocking step).

Figure 4:
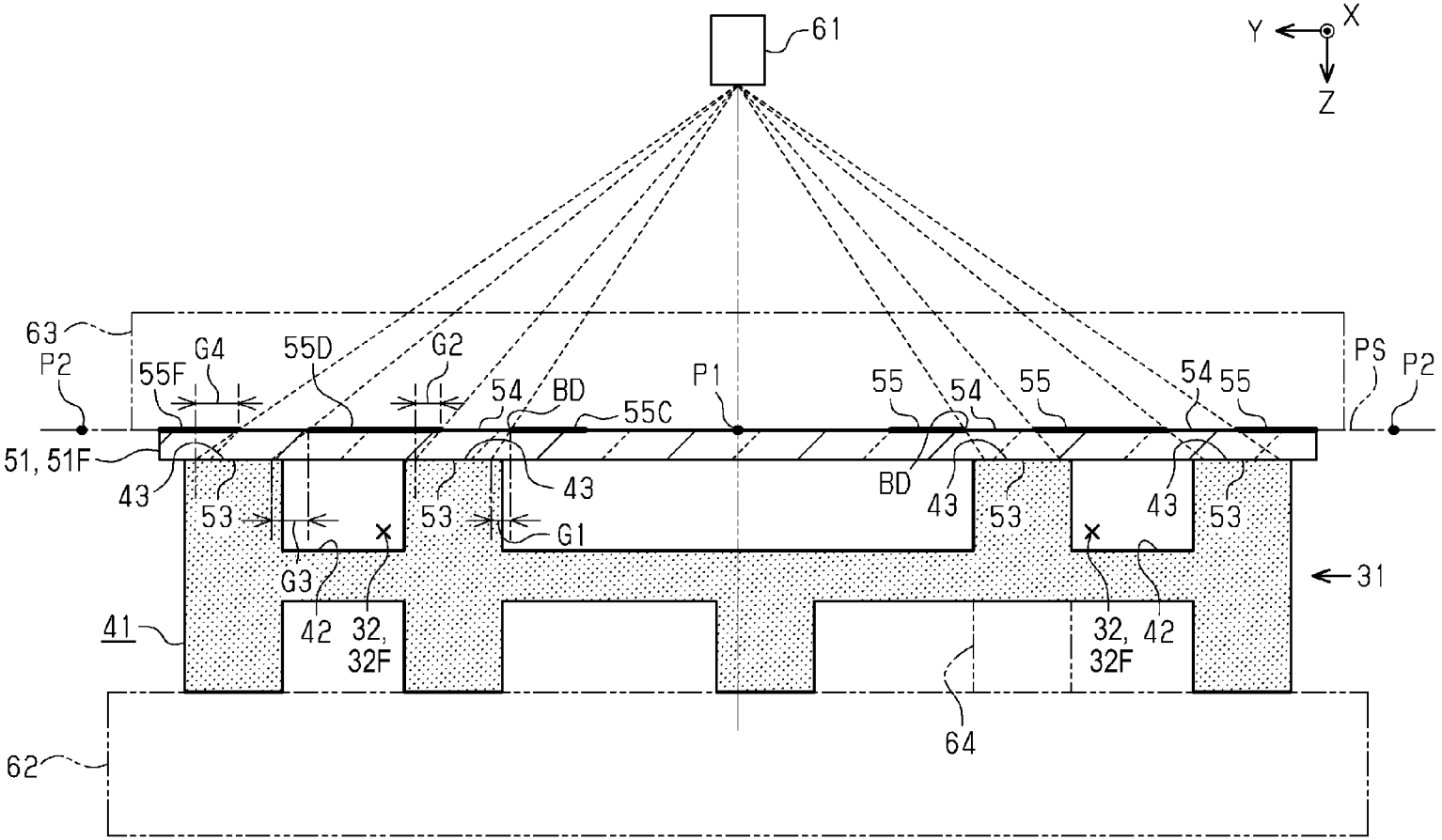
FIG. 4 is a sectional view illustrating a process in which a second flow path-forming member is welded to one surface side of the first flow path-forming member.

Furthermore, as shown in FIG. 4, within the range of irradiation by a light source apparatus 61, the flow path-forming members 41 and 51 (51F) are disposed so that the irradiation surfaces 43 of the first flow path-forming member 41 and the welding surfaces 53 of the second flow path-forming members 51 are in contact with each other. At this time, it is preferable to apply a load in order to reduce the influences of production errors, bending, etc. so that the irradiation surfaces 43 and the welding surfaces 53 certainly come into contact.

For example, the first flow path-forming member 41 is placed on a support table 62 so that the irradiation surfaces 43 face upward. Then, a second flow path-forming member 51 is placed on top of the first flow path-forming member 41 so that the welding surfaces 53 face downward. Then, a pressing member 63 is disposed on the upper surface side of the second flow path-forming member 51. Via the pressing member 63, a load is applied to the second flow path-forming member 51 so that the welding surfaces 53 of the second flow path-forming member 51 are pressed against the irradiation surfaces 43 of the first flow path-forming member 41. If the pressing member 63 is made of a material capable of transmitting laser light (e.g., an acrylic resin, a glass, etc.), the laser light that the pressing member 63 transmits can be delivered to the irradiation surfaces 43.

Furthermore, for example, in the case where the first flow path-forming member 41 is not provided with a support underneath a portion that bears load from the second flow path-forming member 51 and where, therefore, the member partially bends when receiving load, a support portion 64 that bears such load may be provided. In this case, the support portion 64 may be a block separate from the support table 62 or may also be a protruded portion protruded from the support table 62.

The light source apparatus 61 that produces laser light is disposed in a space in contact with the outer surface of the second flow path-forming member 51. The light source apparatus 61 has a laser light source (not graphically shown) and two Galvano mirrors (not graphically shown) that are provided inside the light source apparatus 61. The light source apparatus 61 scans laser light along the direction X by pivoting one of the Galvano mirrors that reflects the light emitted from the laser light source and scans the laser light along the direction Y by pivoting the other Galvano mirror that reflects the laser light. The laser light source may employ an arbitrary light source; however, it is preferable to adopt a YAG laser, which has a long wavelength (1060 to 1070 nm), because it allows precision welding.

The position at which an optical path of laser light from the light source apparatus 61 intersects (e.g., at right angle) with a virtual plane PS that contains the outer surface of the second flow path-forming member 51 is defined as a first reference position P1. The position at which the laser light is incident on the virtual plane PS at an incident angle that is smaller than the incident angle (90 degrees) at the first reference position P1 is defined as a second reference position P2. Then, in the light blocking step, the light blocking portions 55 are disposed so that the boundaries BD between the light blocking portions 55 and the transmitting portions 54 disposed on the opposite side to the irradiation surface 43 are shifted from the external edges of the irradiation surface 43 toward the first reference position P1.

After the light blocking step and the disposing step, the light source apparatus 61 emits laser light and scans the laser light between the first reference position P1 and the second reference position P2 so that the laser light transmitted through the transmitting portions 54 of the second flow path-forming member 51 irradiates the irradiation surfaces 43 (irradiating step). Then, the irradiation surfaces 43 absorbing the laser light produce heat, by which the irradiation surfaces 43 and the welding surfaces 53 fuse and melt with each other. Thus, portions enclosed by interrupted lines in FIG. 5 become welded portions 33.

Figure 5:
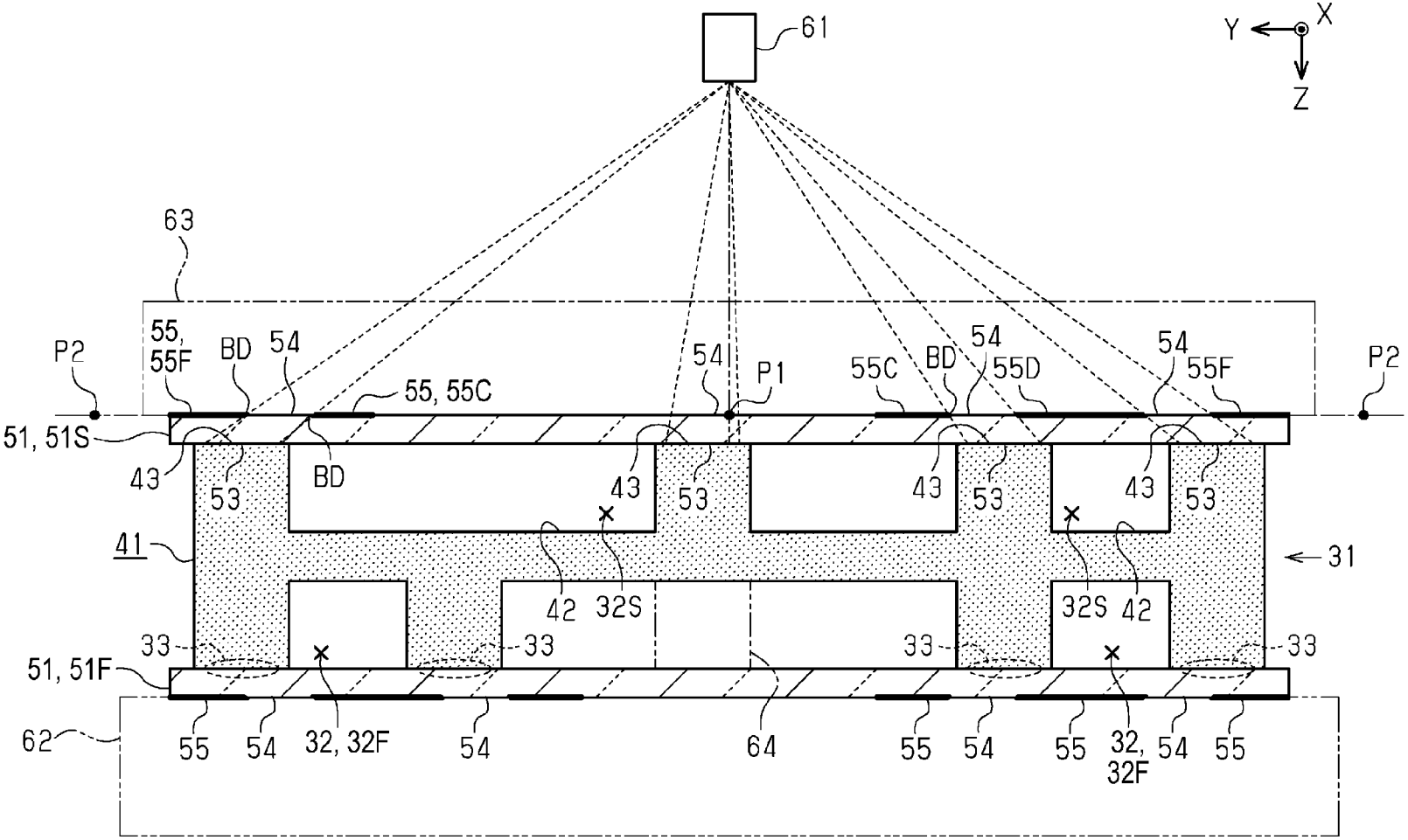
FIG. 5 is a sectional view illustrating a process in which the second flow path-forming member is welded to the other surface side of the first flow path-forming member.

As shown in FIG. 4, after the welding surfaces 53 of the second flow path-forming member 51F are welded to the irradiation surfaces 43 of the one surface side of the first flow path-forming member 41, welding surfaces 53 of the second flow path-forming member 51S may be welded to the irradiation surfaces 43 on the other surface side of the first flow path-forming member 41, as shown in FIG. 5.

In the case where there are an irradiation surface 43 and a welding surface 53 near the first reference position P1 as shown in FIG. 5, there is no need to dispose a light blocking portion 55 at a position that corresponds to that welding surface 53, because the transmitting portion 54 opposite to the welding surface 53 receives laser light at an incident angle close to 90 degrees. Alternatively, if a light blocking portion 55 is disposed at such a position, the positions of the boundaries BD of the light blocking portion 55 with the adjacent transmitting portions 54 do not need to be shifted in the direction Y from the positions of the external edges of the welding surface 53 and the irradiation surface 43.

Operations of the flow path member 31 and the liquid ejecting apparatus 11 constructed as described above will be described.

In the case where laser light is emitted, while being pivoted, from the light source apparatus 61 disposed in a space in contact with the outer surface of the second flow path-forming member 51 and on a plane intersects the outer surface at the first reference position P1, the incident angle of the laser light on the outer surface of the second flow path-forming member 51 becomes smaller from the first reference position P1 toward the second reference position P2. Where laser light is incident on the outer surface of the second flow path-forming member 51 at an angle smaller than 90 degrees, the position on the inner surface that the laser light reaches is shifted or apart, along the surfaces, from the position of incidence of the laser light on the outer surface to the side toward which the laser light travels.

Therefore, for example, if a transmitting portion 54 and a welding surface 53 are aligned in position when viewed from a direction orthogonal to the outer surface of the second flow path-forming member 51, laser light does not reach the inner-side external edge Ec of the irradiation surface 43, which is an edge closer to the first reference position P1, so that a portion that needs to be fused is not fused, giving rise to a possibility of resulting in insufficient welding. If such insufficient welding occurs, the flow path-forming members 41 and 51 are not sufficiently welded, so that fluid may leak from the flow path 32 or an air bubble may enter the flow path 32.

Furthermore, if laser light is delivered beyond the outer-side external edge Ef of an irradiation surface 43 which is closer to the second reference position P2 than the inner-side external edge Ec of the irradiation surface 43, a portion that needs to remain unfused may be heated to produce gas, carbonized and therefore altered in properties, or fused so that fused pieces protrude.

Still further, when such a flow path member 31 is used in a liquid ejecting apparatus 11, there is possibility that an inner wall of a property-altered flow path 32 may react with a liquid (ink), altering properties of the liquid, or that an unnecessarily fused piece produced may reach a liquid ejecting unit 13 and clog a nozzle 12 or an air bubble may enter a flow path 32, resulting in a missing dot in printed images. Alternatively, there is possibility that a bubble may be caught on a protrusion made up of a fused piece or material produced in a flow path 32 and thus impeded from being discharged or a bubble thus caught may grow in size and then reach a nozzle 12, resulting in a missing dot.

With regard to this respect, the light blocking portions 55 on each second flow path-forming member 51 in the flow path member 31 of this exemplary embodiment are disposed in contact, on boundaries BD, with the transmitting portions 54 so that portions outside the irradiation surfaces 43 of the first flow path-forming member 41 can be prevented from being irradiated with laser light. Furthermore, by shifting the positions of the boundaries BD from the external edges of the irradiation surfaces 43 according to the incident angles of the laser light, laser light can be delivered to appropriate ranges. Therefore, the flow path-forming members 41 and 51 can be appropriately welded to form a flow path member 31 without welding failure. Furthermore, since there is no gas produced by unnecessary fusion, a discharge apparatus for discharging such gas does not need to be provided for the irradiating step.

Note that if a second flow path-forming member 51 is made up of a transparent member, transparent portions of the member 51 allow surroundings of the flow paths 32 to be visually recognized, so that the presence or absence of a protrusion formed by unnecessary fusion, the presence or absence of fluid leakage due to insufficient welding, etc., can be easily detected.

The foregoing exemplary embodiment can achieve the following advantageous effects.

(1) When a second flow path-forming member 51 and a first flow path-forming member 41 are welded by laser light transmitted through the second flow path-forming member 51, external edges of the welded portions 33 are formed at positions that the laser light that passes through the boundaries BD between the light blocking portions 55 and the transmitting portions 54 reaches. In the case where laser light is incident on a boundary BD at an incident angle of 90 degrees, the positions of that boundary BD and the corresponding external edge of the welded portion 33 coincide with each other when viewed from a direction orthogonal to the outer surface of the second flow path-forming member 51. In the case where laser light is incident on a boundary BD at an incident angle less than 90 degrees, the position of the corresponding external edge of the welded portion 33 is shifted away from the position of the boundary BD to the side toward which the laser light travels. With regard to this respect, according to the exemplary embodiment, the positions of the external edges of the welded portions 33 are set according to the incident angles of laser light so that the first flow path-forming member 41 and the second flow path-forming members 51 of the flow path member 31 are appropriately welded. Therefore, a flow path member 31 in which flow path-forming members 41 and 51 are appropriately welded can be provided.

(2) The positional shifts of the external edges of the welded portions 33 relative to the boundaries BD become larger from the first reference position P1 toward the second reference position P2. Therefore, even if the light source apparatus 61 disposed at a position closer to the first reference position P1 than to the second reference position P2 in a space in contact with the outer surface of the second flow path-forming member 51 emits laser light while pivoting the light, appropriate welding is carried out. Hence, the flow paths 32 of the flow path member 31 formed by the first flow path-forming member 41 and the second flow path-forming members 51 that are appropriately welded as described above do not have an unnecessary fused piece that disturbs fluid flow or insufficient welding that results in liquid leakage.

(3) A welded portion 33 of each second flow path-forming member 51 is provided so that the position of the inner-side external edge Ec of that welded portion 33 is set by a corresponding inner-side light blocking portion 55C that is shifted in position so as to be apart from the inner-side external edge Ec and the position of the outer-side external edge Ef of the welded portion 33 is set by a corresponding outer-side light blocking portion 55F that is shifted in position so as to lie over the outer-side external edge Ef. Therefore, welding failure is unlikely to occur.

(4) Because laser light incident on regions between the inner-side light blocking portions 55C and the outer-side light blocking portions 55F of a second flow path-forming member 51 penetrates the second flow path-forming member 51, the second flow path-forming member 51 is provided with welded portions 33 formed due to the welding with the first flow path-forming member 41. The incident angle of laser light reaching the outer-side external edge Ef of each welded portion 33 which is closer to the second reference position P2 than the inner-side external edge Ec thereof is smaller than the incident angle of laser light reaching the inner-side external edge Ec of the same welded portion 33 which is closer to the first reference position P1 than the outer-side external edge Ef thereof. Therefore, by shifting the outer-side light blocking portions 55F to greater extents than the inner-side light blocking portions 55C as in the foregoing exemplary embodiment so that the two groups of light blocking portions 55 are appropriately disposed according to the incident angles of laser light, the positions of the external edges of the welded portions 33 can be appropriately set. Due to this, it is possible to substantially prevent the occurrence of a fused piece caused by excessively shifting an inner-side light blocking portion 55C and the insufficient welding caused by insufficiently shifting an inner-side light blocking portion 55C. It is also possible to substantially prevent the insufficient welding caused by excessively shifting an outer-side light blocking portion 55F and the occurrence of a fused piece caused by insufficiently shifting an outer-side light blocking portion 55F.

(5) If the light blocking portions 55 are formed as rough surfaces whose surface roughness is greater than that of the transmitting portions 54, the laser light that is incident on the rough surfaces of the second flow path-forming member 51 reflects in various directions and thus scatters, so that the quantity of laser light that reaches the first flow path-forming member 41 is reduced. Thus, the light blocking portions 55 made up of rough surfaces can block laser light incident from the outer surface side. Furthermore, if the light blocking portions 55 are rough surfaces, the light blocking portions 55 can be easily disposed on the second flow path-forming member 51.

(6) If the light blocking portions 55 of a second flow path-forming member 51 are portions colored in a color that can reflect or absorb laser light, the laser light incident on the colored portions of the second flow path-forming member 51 is reflected or absorbed, so that the quantity of laser light that reaches a fusing surface is reduced. Thus, the light blocking portions 55 made up of colored outer surfaces of a second flow path-forming member 51 can block laser light incident from the outer surface side. Furthermore, by forming light blocking portions 55 through coloring, the light blocking portions 55 of the second flow path-forming member 51 can be easily provided.

(7) If the flow path member 31 of the foregoing exemplary embodiment is used in the liquid ejecting apparatus 11, the occurrence of incomplete discharge or ejection of a liquid, such as the clogging of a nozzle 12 or a missing dot, resulting from welding failure of the flow path member 31 can be substantially prevented.

(8) According to the production method for the flow path member 31 in the foregoing exemplary embodiment, light blocking portions 55 are disposed relative to the external edges of irradiation surfaces 43 so that the boundaries BD of the light blocking portions 55 are shifted toward the first reference position P1. Therefore, the transmitting portions 54 in contact, on the boundaries BD, with the light blocking portions 55 are set at positions that are shifted relative to the irradiation surfaces 43 according to the incident angles of laser light. Therefore, even in the case where the incident angles of laser light vary, the positions that are irradiated with laser light can be set according to the variations of the incident angles so as to coincide with the irradiation surfaces 43. Therefore, a flow path member 31 in which flow path-forming members 41 and 51 are appropriately welded can be provided.

The foregoing exemplary embodiment may be changed as in modifications described below. The foregoing exemplary embodiment and the following modifications can be arbitrarily combined.

Figure 6:
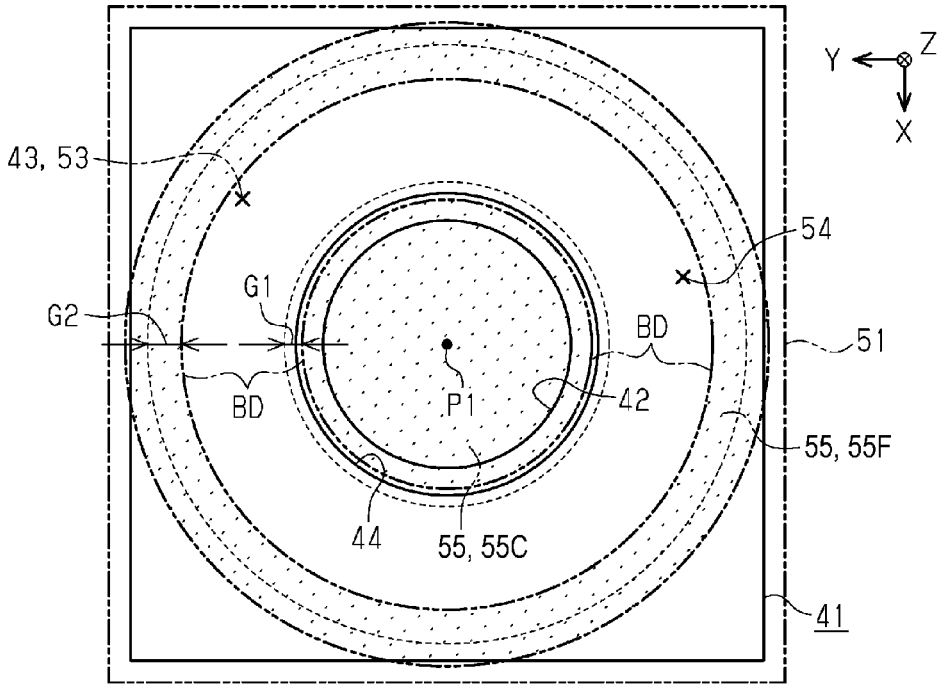
FIG. 6 is a plan view illustrating a process of the production of a flow path member according to a modification in which a second flow path-forming member provided with light blocking portions is disposed on a first flow path-forming member.
Figure 7:
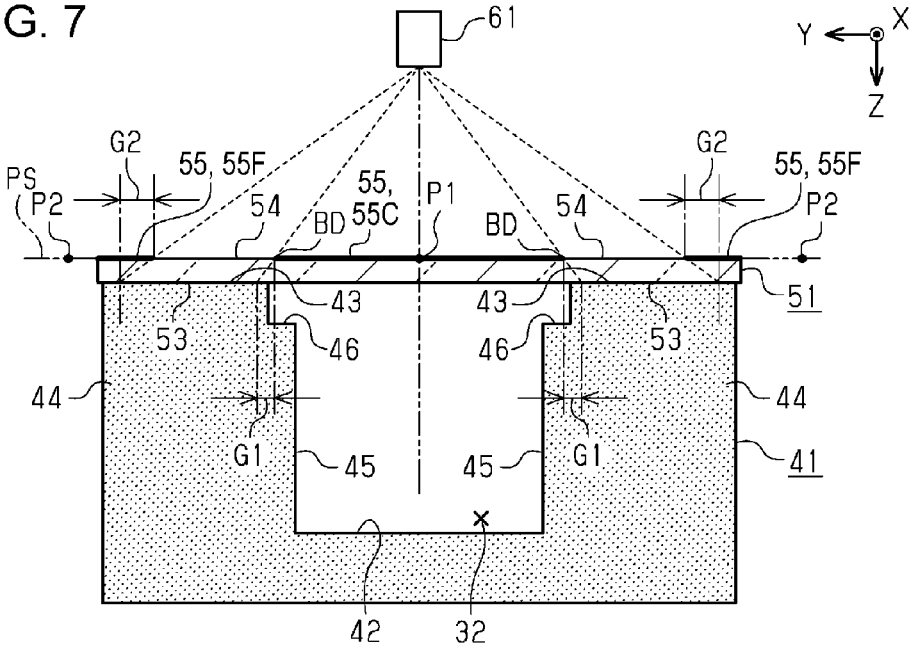
FIG. 7 is a sectional view illustrating a process in the production of the flow path member shown in FIG. 6 in which the first flow path-forming member and the second flow path-forming member are welded.

In a modification as shown in FIGS. 6 and 7, protruded portions 44 of a first flow path-forming member 41 may have inner wall surfaces 45 which extend in a direction that intersects distal end surfaces (irradiation surfaces 43) of the protruded portions 44 and which partially define a flow path 32 and each protruded portion 44 may have a cutout 46 in a portion of a corner at which an extension of the inner wall surface 45 and an extension of the distal end surface intersect. Note that each cutout 46 may be formed by an inner wall surface 45 and an inclined surface that diagonally intersects the irradiation surface 43.

According to this construction, since the protruded portions 44 of the first flow path-forming member 41 have in the corner portions the cutouts 46, the cutouts 46 can receive therein a fused piece or material if any such fused piece or material should be produced because laser light is delivered to a location outside the irradiation surfaces 43 due to production errors and the like of the flow path-forming members 41 and 51. In consequence, formation of a fused piece that is protruded from an inner wall surface 45 into the flow path 32 so as to impede liquid flow can be avoided.

As in the modification shown in FIGS. 6 and 7, a flow path 32 may be a liquid storage portion having a circular shape in a plan view taken from the outer surface side of the second flow path-forming member 51. Furthermore, in the case where, as shown in FIG. 7, two light blocking portions 55 each include an inner-side light blocking portion 55C and an outer-side light blocking portion 55F, the outer-side light blocking portions 55F provided at opposite sides of the first reference position P1 may be a continuously formed outer-side light blocking portion 55F as shown in FIG. 6.

In the light blocking step, light blocking portions 55 may be formed on the outer surface of a second flow path-forming member 51 by sticking seals having a light blocking effect to the outer surface or mounting sheet-shaped light blocking members on the outer surface. In this case, the light blocking step may be performed after the disposing step. Furthermore, in this case, the flow path member 31 obtained after removing the light blocking portions 55 disposed in a production process may be mounted in a liquid ejecting apparatus 11.

The liquid that the liquid ejecting unit 13 ejects is not limited to ink but may also be, for example, a liquid material in which a particle of a functional material is dispersed or mixed in a liquid. For example, the liquid ejecting unit 13 may be constructed so as to perform recording by ejecting a liquid material that contains in the form a dispersion or solution a material such as a color material (pixel material) or an electrode material used in the production of liquid crystal displays, EL (electroluminescence) displays, surface emitting displays, etc.

The flow path member 31 is not limited to use in the liquid ejecting apparatus 11 but may also be used in arbitrary apparatuses in which a fluid, such as a liquid, flows.

The target S is not limited to a sheet of paper but may also be a plastic film, a thin platy member, etc., and may also be a cloth for use in a textile printing apparatus.

The entire disclosure of Japanese Patent Application No. 2015-237714, filed Dec. 4, 2015, is expressly incorporated by reference herein.

What is claimed is:

1. A flow path member in which a plurality of flow path-forming members forms a flow path, the flow path member comprising:

a first flow path-forming member made of a material capable of absorbing a laser light; and a second flow path-forming member made of a material that has a lower absorbance with respect to the laser light than the first flow path-forming member and having in a portion of an inner surface that at least partially forms the flow path at least one welded portion that is welded to the first flow path-forming member, wherein an outer surface side of the second flow path-forming member that is an opposite side to the inner surface is provided with at least one light blocking portion capable of blocking the laser light and at least one transmitting portion that is capable of transmitting the laser light and that is positioned on an opposite side to the at least one welded portion and the at least one light blocking portion and the at least one transmitting portion are in contact on at least one boundary with each other, and wherein at least one external edge of the at least one welded portion is at a position that is shifted by a shift from the at least one boundary to a side toward which the laser light incident on the at least one boundary at an incident angle less than 90 degrees travels.

2. The flow path member according to claim 1, wherein the outer surface of the second flow path-forming member is provided with a plurality of the at least one boundary that intersects a straight line connecting a first reference position and a second reference position that are apart from each other, and wherein each of the at least one external edge of the at least one welded portion is shifted in position from a corresponding one of the plurality of boundaries by the shift that becomes larger from the first reference position toward the second reference position.

3. The flow path member according to claim 2, wherein the at least one light blocking portion includes an inner-side light blocking portion that corresponds to an inner-side external edge of one of the at least one welded portion which is closer to the first reference position than an outer-side external edge of the one of the at least one welded portion and that is shifted in position so as to be apart from the inner-side external edge and an outer-side light blocking portion that corresponds to the outer-side external edge of the one of the at least one welded portion which is closer to the second reference position than the inner-side external edge of the one of the at least one welded portion and that is shifted in position so as to lie over the outer-side external edge.

4. The flow path member according to claim 3, wherein the shift of the outer-side light blocking portion is larger than the shift of the inner-side light blocking portion.

5. The flow path member according to claim 1, wherein the first flow path-forming member has a protruded portion that is welded to the second flow path-forming member to become the welded portion, and wherein the protruded portion has an inner wall surface that extends in a direction intersecting the irradiation surface and that forms the flow path, and wherein the protruded portion has a cutout in a portion of a corner that is substantially defined by an extension of the irradiation surface and an extension of the inner wall surface intersecting each other.

6. The flow path member according to claim 1, wherein the light blocking portion is a rough surface that has a greater surface roughness than the transmitting portion.

7. The flow path member according to claim 1, wherein the light blocking portion is a portion of the outer surface of the second flow path-forming member that is colored in a color capable of reflecting or absorbing the laser light.

8. A liquid ejecting apparatus comprising:

a liquid ejecting unit that ejects a liquid; and the flow path member according to claim 1.

9. A production method for producing a flow path member that includes a flow path by laser-welding a plurality of flow path-forming members, the production method comprising:

disposing a first flow path-forming member made of a material capable of absorbing a laser light and a second flow path-forming member made of a material that has a lower absorbance with respect to the laser light than the first flow path-forming member so that an irradiation surface of the first flow path-forming member and a welding surface of the second flow path-forming member are in contact with each other;

providing a light blocking portion capable of blocking the laser light on an outer surface side of the second flow path-forming member which is an opposite side to an inner surface provided with the welding surface so that the light blocking portion is in contact on a boundary with a transmitting portion that transmits the laser light to the welding surface; and irradiating, after the first flow path-forming member and the second flow path-forming member are provided and the light blocking portion is provided, the irradiation surface with the laser light transmitted through the transmitting portion by emitting the laser light from a light source apparatus that is disposed in a space in contact with the outer surface of the second flow path-forming member, wherein, when a position at which an optical path extending from the light source apparatus intersects a virtual plane that contains the outer surface is defined as a first reference position and a position at which the laser light is incident on the virtual plane at a smaller incident angle than at the first reference position is defined as a second reference position, the light blocking portion is disposed so that the boundary is shifted toward the first reference position with respect to an external edge of the irradiation surface.

* * * * *